United States Patent [19]

Livingstone et al.

[11] 4,136,842

[45] Jan. 30, 1979

[54] FLEXIBLE DYE TUBE

[75] Inventors: Stanley Livingstone, Charlotte; Gordon H. Broome, Mount Holly, both of N.C.

[73] Assignee: American & Efird Thread Mills, Inc., Mount Holly, N.C.

[21] Appl. No.: 819,400

[22] Filed: Jul. 27, 1977

[51] Int. Cl.[2] ..... B65H 75/20

[52] U.S. Cl. ..... 242/118.11

[58] Field of Search ..... 68/198; 242/118.1, 118.11, 242/118.2

[56] References Cited

U.S. PATENT DOCUMENTS

| | | | |
|---|---|---|---|
| 2,162,841 | 6/1939 | Dunlap | 242/118.1 |
| 3,448,597 | 6/1969 | Livingstone | 68/198 |
| 3,563,491 | 2/1971 | Hahm et al. | 242/118.11 |
| 3,718,287 | 2/1973 | Sottosanti | 242/118.11 |
| 3,756,532 | 9/1973 | Draper | 242/118.11 |
| 3,759,460 | 9/1973 | Fyans | 242/118.1 |
| 3,882,698 | 5/1975 | Livingstone et al. | 68/198 |

FOREIGN PATENT DOCUMENTS

| | | | |
|---|---|---|---|
| 979791 | 1/1965 | United Kingdom | 242/118.1 |
| 1233417 | 5/1971 | United Kingdom | 242/118.11 |

*Primary Examiner*—Philip R. Coe

[57] ABSTRACT

A tube for use on a perforated dyeing spindle, for supporting for dyeing a package of yarn wound therearound, the tube having a longitudinal axis and comprising a plurality of flexible uprights spaced circumferentially around the axis, top and bottom base portions of the tube, each upright being joined at opposite ends to the base portions, respectively, and a plurality of rings joining the uprights in spaced planes perpendicular to the axis, at least two of the rings being incomplete and having, respectively, gaps at circumferentially staggered positions so as to leave one pair of adjacent uprights free to approach each other in one of the planes and a second pair of adjacent uprights free to approach each other in a second of the planes, thereby providing the tube with balanced and limited radial flexibility to accommodate yarn shrinkage, the spaced uprights, base portions, and rings cooperatively defining a plurality of dye openings through the tube.

14 Claims, 3 Drawing Figures

FLEXIBLE DYE TUBE

BACKGROUND OF THE INVENTION

This invention relates to tubes for supporting for dyeing a package of yarn wound therearound, and provides an improvement in certain respects in the dye tubes disclosed in U.S. Pat. Nos. 3,448,597 and 3,882,698, both hereby incorporated by reference.

SUMMARY OF THE INVENTION

Shrinking after dyeing of polyester and other yarns produces great crushing forces on dye tubes, tending to break or permanently distort the tubes, preventing their reuse.

The invention provides a simple, inexpensive, easy to manufacture and convenient to use dye tube capable of accommodating the crushing forces of shrinking yarns in repeated uses. The tube can be a one-piece construction.

The invention allows minimization of the contact area between the yarn and the tube surfaces while maximizing dye saturation of the yarn, and also provides for uniform absorption of the dye without "cross-overs" or light colored spots on the yarn caused by undue pressure on dye tube surfaces. Furthermore the tubes can easily and quickly (and even automatically) be stacked around a dyeing spindle, well sealed to each other even during shrinking of the yarn, without requiring separate spacers between adjacent tubes, and without overly restricting axial flow of dye between the tubes and the spindle. The tubes can be removed easily from the spindle even after yarn shrinkage, and are suitable for use with automatic unloaders which tip the spindles and depend upon gravity for removal of the tubes. Finally, the tubes retain the yarn in orderly windings even after shrinkage, and are useful with yarns of many different physical characteristics.

The tube disclosed in U.S. Pat. No. 3,448,597 did not have the flexibility to accommodate yarn shrinkage. The tube disclosed in U.S. Pat. No. 3,882,698 was an improvement in that respect, but in use proved to be subject to permanent deformation (e.g., by twisting), making removal from the spindle difficult and limiting reuse. Efforts to strike a happy medium by using a single ring to join the uprights halfway between the tube ends were also unsuccessful.

In general the invention features uprights joined by rings with gaps at circumferentially and axially staggered positions to accommodate yarn shrinkage while limiting excessive deformation of the tube. In preferred embodiments the gaps are located in an axially central plane and two other planes spaced symmetrically from the center, with one gap between each pair of adjacent uprights.

Other advantages and features of the invention will be apparent from the description and drawings herein of a preferred embodiment thereof.

DESCRIPTION OF THE PREFERRED EMBODIMENT

Figure 1:
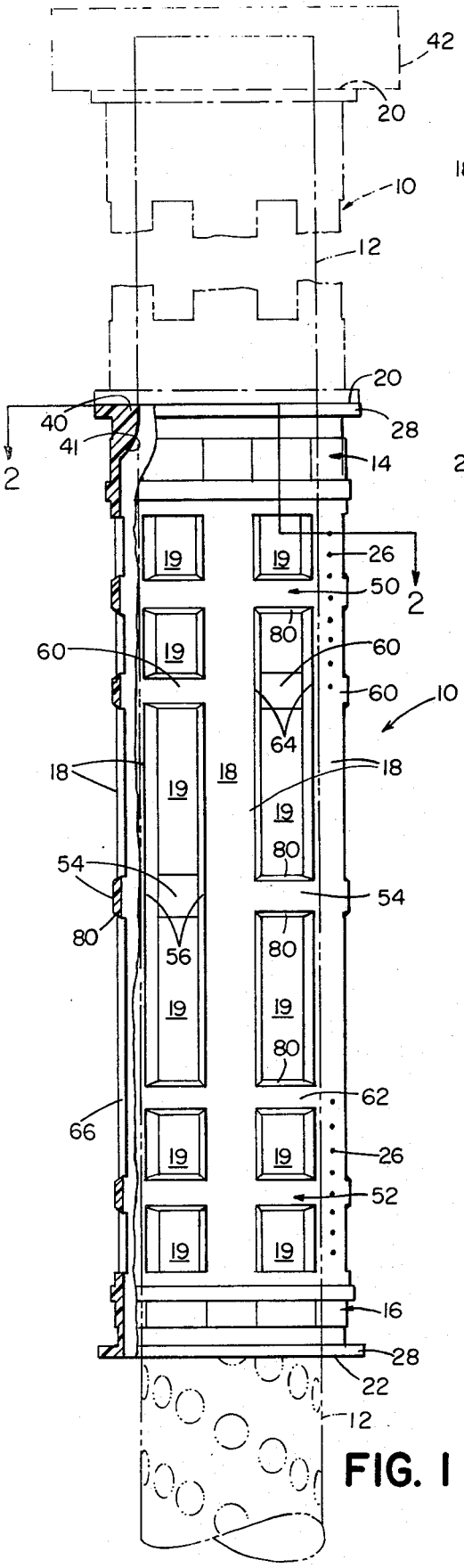
FIG. 1 is a view partially in section, with portions cut away, showing a dye tube on a spindle, with the spindle and fragments of a second tube being shown in dashed lines.
Figure 2:
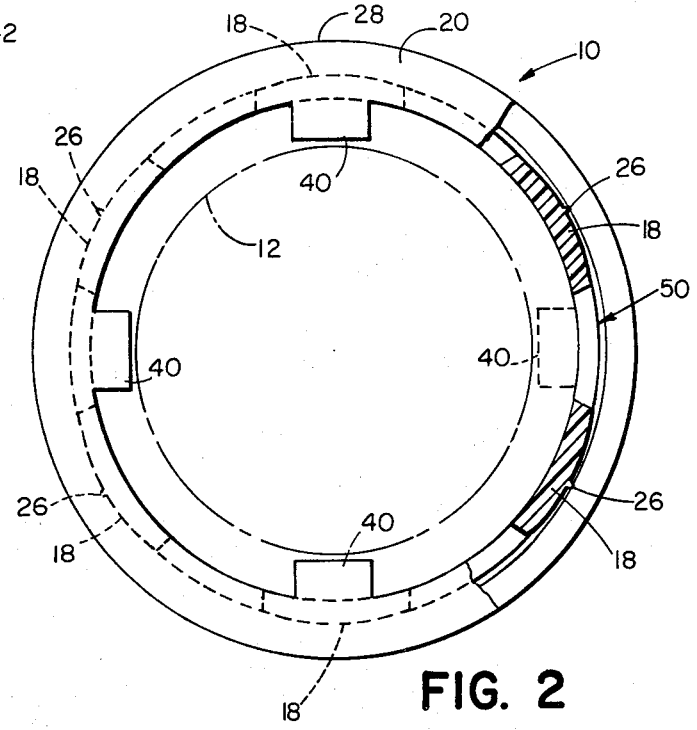
FIG. 2 is a section through 2—2 of FIG. 1.
Figure 3:
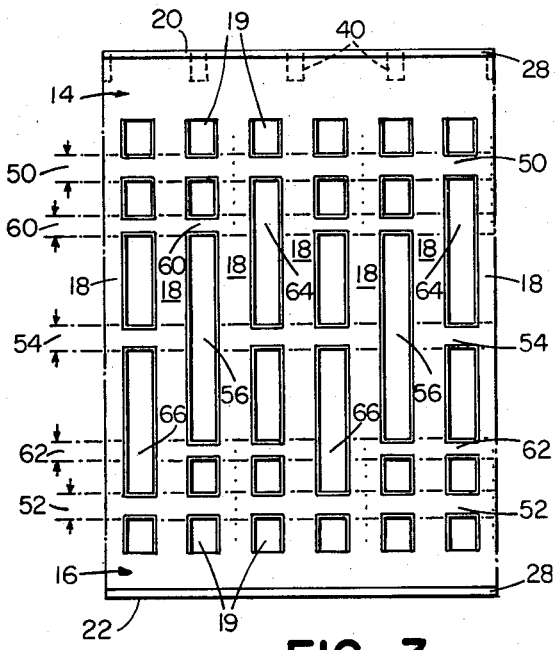
FIG. 3 is an unfolded, semi-schematic view, of a dye tube embodying the invention.

Dye tubes 10 made of polypropylene with talc added to minimize shrinkage are stacked end to end on perforated dye spindle 12, and include top and bottom imperforate base portions 14, 16 to which are joined six ½ inch wide axially extending uprights 18 circumferentially spaced 11/32 inches apart.

Each base portion 14, 16 includes an annular end sealing surface 20, 22 of inside diameter 1⅝ inch and of outside diameter 2 inches. Dye spindle 12 has an outer diameter of of 1.315 inch.

Base portion 14 is slightly longer than portion 16 and has four vertical lugs 40 spaced circumferentially around its inner surface, to give the tube an effective inner diameter at one end slightly larger than the outer diameter of spindle 12, thereby helping to align adjacent stacked tubes on spindle 12 with adjacent opposing surfaces 20, 22 in sealing relation to each other. Lugs 40 are tapered at ends 41 to slide easily over the spindle. Each base portion 14, 16 also includes an annular ridge 28 adjacent annular end sealing surface 20, 22 by which arrangement strength is maintained, while the amount of material used in the base portion is minimized.

Spaced axially about 7/16" from each base portion 14, 16 is a 5/16" wide (in the axial direction) ring 50, 52 connecting each upright 18 to its adjacent uprights. A similar ring 54, axially centered on the tube, is cut away to provide gaps 56 between two pairs of uprights 180° apart. Two further rings 60 and 62, ¼" wide, respectively spaced 7/16" from rings 50 and 52, are also cut away to provide gaps 64 and 66 between two other pairs of uprights 180° apart. Thus, the six gaps are in three different, axially spaced planes, and are circumferentially staggered with one between each pair of adjacent uprights.

The ring edges are relieved by bevelling, e.g., at 80, between uprights to prevent yarn snagging.

In use, yarn is wound on the tube at a 20° slant, except at the ends of the tube where the winding is almost in a plane perpendicular to the tube axis. The winding tends to be tighter at the tube ends, and complete rings 50 and 52 prevent excessive deformation there. Protuberances 26 help to prevent yarn slippage. The spaces 19 between the uprights 18 allow for high dye saturation of the yarn. The outer surfaces of the uprights and rings comprise at least 50 percent of the cylindrical surface on which those surfaces lie, minimizing cross-overs and preventing the shrunken yarn from binding on the spindle. Advantageously, the inner surfaces of the uprights and rings also lie on a cylindrical surface. Dye can flow axially between spindle 12 and tube 10 between lugs 40. Surfaces 20, 22 limit dye flow radially between adjacent stacked tubes. After dyeing, when the yarn dries and shrinks, the gaps in the rings allow pairs of adjacent uprights to approach each other (and the tube axis) locally at axially and circumferentially staggered positions over the major central portion of the tube, while the rings otherwise prevent excessive compression, twisting, or other deformation of the tubes. Since squeezing of the uprights will shorten the stack column, a spring loaded spindle nut 42 is attached to the top of the spindle to maintain a sealed column regardless of shrinkage or expansion of the column by applying a downward pressure on the stacked tubes. The tubes can be easily removed from the spindle, and, when the yarn is unwound, will spring back to their original position for reuse.

Other embodiments are within the following claims.

We claim:

1. A tube for use on a perforated dyeing spindle, for supporting for dyeing a package of yarn wound therearound, said tube having a longitudinal axis and comprising:

a plurality of flexible uprights spaced circumferentially around said axis, top and bottom base portions of the tube, each said upright being joined at opposite ends to said base portions, respectively, and a plurality of rings joining said uprights in spaced planes perpendicular to said axis, at least two of said rings being incomplete by having, respectively, gaps at circumferentially staggered positions so as to leave one pair of adjacent uprights free to approach each other in one of said planes and a second pair of adjacent uprights free to approach each other in a second of said planes, each portion of each ring adjacent to a gap extending circumferentially to join more than two adjacent uprights, thereby providing said tube with balanced and limited radial flexibility to accommodate yarn shrinkage, said spaced uprights, base portions, and rings cooperatively defining a plurality of dye openings through said tube.

2. The tube of claim 1 wherein at least one said ring has gaps between two pairs of adjacent uprights.

3. The tube of claim 2 wherein said gaps in said one ring are 180° apart circumferentially.

4. The tube of claim 1 wherein between each pair of adjacent uprights is located a said gap in the plane of one of said incomplete rings, whereby upon yarn shrinkage pairs of adjacent uprights aproach each other locally at axially and circumferentially spaced positions over the major central portion of said tube.

5. The tube of claim 1 wherein adjacent but spaced from each said base is a complete ring joining all said uprights.

6. The tube of claim 1 wherein a first of said incomplete rings is located halfway between said bases, and two additional incomplete rings are spaced symmetrically on both sides of said first ring.

7. The tube of claim 6 wherein said first and two additional rings each have two gaps 180° apart, circumferentially staggered from ring to ring.

8. The tube of claim 6 wherein there are six said uprights equally spaced circumferentially.

9. The tube of claim 8 wherein adjacent but spaced from each said base is a complete ring joining all said uprights.

10. The tube of claim 6 wherein said two additional rings are narrower than said first ring.

11. The tube of claim 1 wherein outer surfaces of said uprights and rings lie in a common cylindrical surface.

12. The tube of claim 1 comprising a single piece of plastic.

13. The tube of claim 1 wherein the edges of said rings are relieved between uprights to prevent yarn snag.

14. The tube of claim 1 wherein each portion of each said incomplete ring joins exactly three adjacent uprights.

* * * * *